US005463278A

United States Patent [19]

Gray

[11] Patent Number: 5,463,278

[45] Date of Patent: Oct. 31, 1995

[54] METHOD AND APPARATUS FOR RANDOM FREQUENCY OF TUBE FILAMENT CURRENT

[75] Inventor: Craig S. Gray, Walton, Ind.

[73] Assignee: Delco Electronics Corporation, Kokomo, Ind.

[21] Appl. No.: 283,323

[22] Filed: Aug. 1, 1994

[51] Int. Cl.[6] ..... H05B 37/02

[52] U.S. Cl. ..... 315/169.1; 315/97; 315/105; 315/46

[58] Field of Search ..... 315/169.1, 349, 315/344, 326, 208, 291, 307, 224, 209 R, 105, 106, 107, 102, 97, 94, 46, 49, 64, 68, 1

[56] References Cited

U.S. PATENT DOCUMENTS 4,241,278 12/1980 Walther ..... 315/169.1

FOREIGN PATENT DOCUMENTS 498794 3/1992 Japan ..... 315/105

*Primary Examiner*—Robert J. Pascal
*Assistant Examiner*—Michael Shingleton
*Attorney, Agent, or Firm*—Jimmy L. Funke

[57] ABSTRACT

Radiated emission is reduced in a vacuum fluorescent tube having a pulsed filament current in a variable frequency range above audible frequencies. A driver circuit produces a fixed width pulse of filament current when triggered by a random frequency generator. The frequency generator comprises a shift register and XOR gates intercoupled to generate a random series of logic outputs, a filter to produce a randomly varying voltage from the logic outputs, and a voltage-to-frequency converter responsive to the filter voltage to yield a random frequency in the required range. The random frequency triggers the driver and clocks the shift register.

13 Claims, 1 Drawing Sheet

METHOD AND APPARATUS FOR RANDOM FREQUENCY OF TUBE FILAMENT CURRENT

FIELD OF THE INVENTION

This invention relates to energizing vacuum fluorescent tube filaments and particularly to a method and a circuit for supplying a pulsed filament current having low electromagnetic emissions.

BACKGROUND OF THE INVENTION

Automotive instrument clusters often use a vacuum fluorescent (VF) tube which provides an illuminated display. The filaments of typical VF tubes used in the automotive environment are driven by approximately 1.5 to 1.8 volts DC. This voltage is obtained by taking the battery voltage (approximately 13.2 volts) and reducing it to the required voltage through the use of dropping resistors. The normal current of the filament is 300 to 400 mA. thus, the resistors used are large wattage and generate a lot of heat. This is not desirable or practical for many applications due to cost and packaging constraints.

The operation of a VF tube only requires that the filament be heated to a certain level by application of current. By providing a pulsed current of larger amplitude than the DC voltage normally used to drive the VF filament, the high wattage dropping resistors can be eliminated. Even battery voltage may be used. The duty cycle of the pulses is chosen to provide the necessary power level of the filament, and the frequency is above audible range to prevent audible noise or singing of the filament. However, when pulsing the VF filament in this manner the radiated emission level may be objectionable.

SUMMARY OF THE INVENTION

It is therefore an object of the invention to eliminate high wattage dropping resistors for VF tube filaments and at the same time avoid objectionable levels of radiated emission. Another object of the invention is to energize vacuum fluorescent tube filaments with a pulsed current at a low level of electromagnetic interference.

The invention provides a method and a circuit which provide current pulses to the filament at an average duty cycle sufficient for the required filament power level, but at a random frequency in a band above audible frequencies. By randomly varying the frequency of the pulses, the emission levels are changed from narrow band to broad band noise. The emissions frequency is more widely distributed to reduce noise amplitudes in local spectrum regions. Thus the radiated emission performance of the system is improved.

A random frequency generator designed to operate in a particular band above audible frequencies produces a stream of output pulses at a variable frequency. The output pulses trigger a driver circuit which produces fixed width filament current pulses, one for each output pulse. The fixed width of the current pulses is selected to produce the desired filament power at the average frequency or center frequency of the range. Since the power depends on the square of the current amplitude (or the square of the voltage for a fixed resistance), a very small duty cycle is required when the applied pulse voltage is only a few times the equivalent DC voltage. To avoid extremely small pulse widths which can aggravate the emissions problem, the frequency band is selected to be in a low range just above the audible range. For the same reason, depending on the application, it may be preferred to use a pulse voltage less than the battery voltage.

The random frequency may be generated by a microprocessor, by a custom integrated circuit, or by a discrete component circuit. The latter takes the form of a shift register and an exclusive OR (XOR) gate arrangement intercoupled so that each feeds inputs to the other, to produce a pseudo-random sequence of logic bits (1's and 0's) which are filtered to produce a random analog voltage, and a voltage-to-frequency converter responsive to the filter voltage to yield a stream of pulses at a random frequency in the desired range. Those pulses control the driver circuit but also are used to clock the shift register so that the register and XOR gate combination operate at the random frequency.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

According to the invention, the radiated emissions from a pulsed filament current are significantly reduced by randomly varying the pulse frequency over a range. The filament pulse frequency is selected to be in a range above audible frequencies; in practice, a range of 20 kHz to 40 kHz, or other similar range having a center frequency of about 30 kHz is found to be useful. While the lower value of 20 kHz is chosen as the upper limit of audible frequencies, the wide band affords sufficient latitude for variation of emissions. A given filament frequency will yield a particular spectrum of radiation, having spikes at certain frequencies, and by varying the frequency the spectrum is also varied, generally reducing the emissions at each frequency and sometimes eliminating emissions at a certain frequency. Using a weighted mean average measure of emissions in which each frequency region is weighted according to its criticality in radio or other vehicle system performance, the circuit described herein reduced the emissions by as much as 25%. This reduction is adequate in many cases to render a display circuit which is otherwise unacceptable or only marginally acceptable, to successfully meet established standards for radiated emissions.

Figure 1:
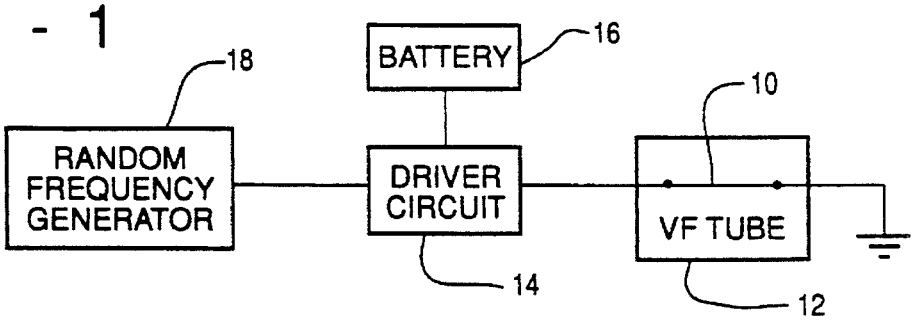
FIG. 1 is a block diagram of a vacuum fluorescent driver according to the invention.
Figure 2:
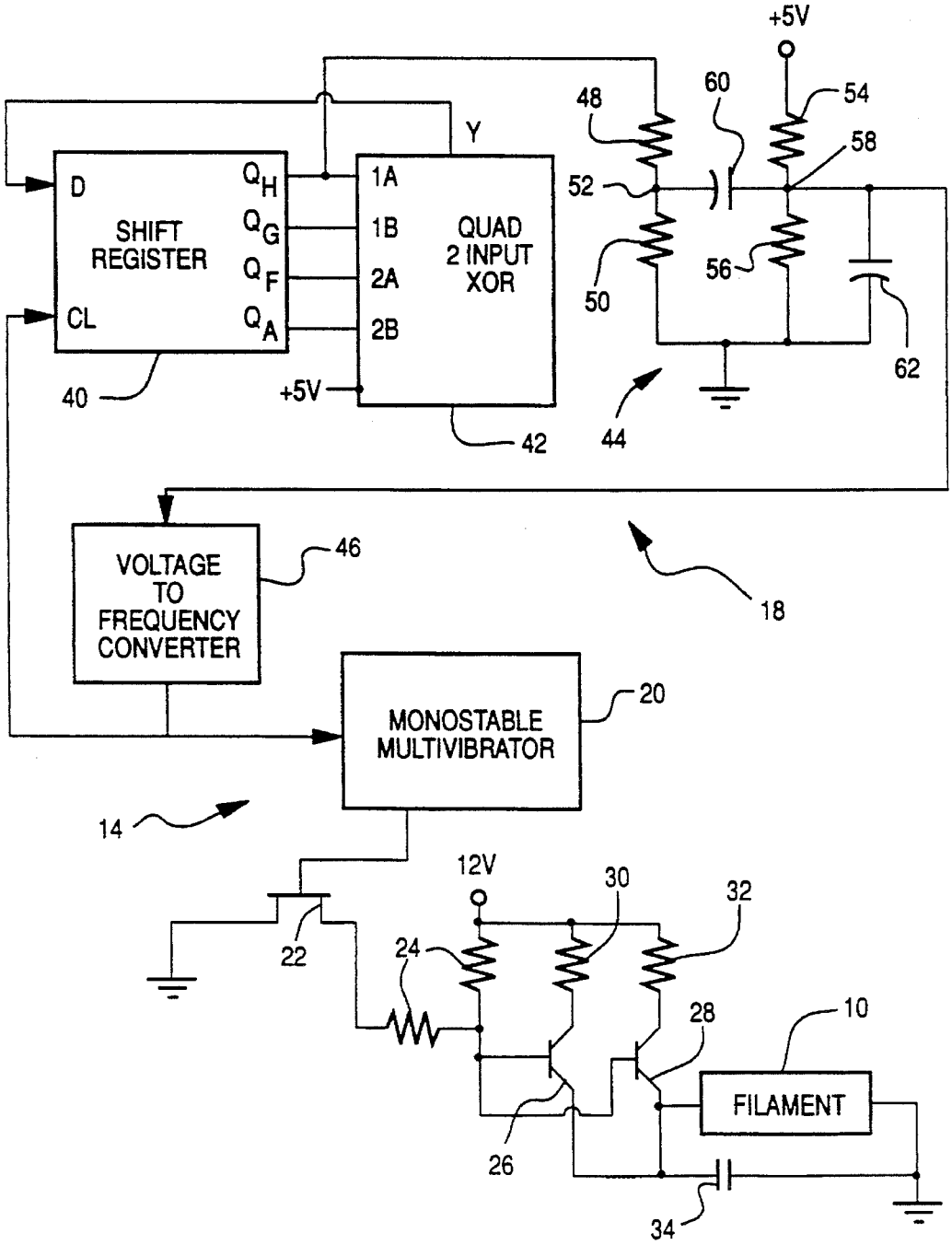
FIG. 2 is a schematic diagram of the circuit of FIG. 1.

Referring to FIGS. 1 and 2, a filament 10 of a vacuum fluorescent tube 12 for an automotive instrument display is energized by a driver circuit 14 which applies voltage from a vehicle battery 16. A random frequency generator 18 supplies a variable frequency which triggers the driver circuit 14. Although the frequency varies it is preferred to maintain a constant pulse width which is chosen to yield the desired filament power level over the frequency range for a given applied voltage. The duty cycle thus varies according to the frequency or period of adjacent pulse events. The pulse width varies inversely and exponentially with voltage; thus to afford the same power level as 1.7 volts DC, an 8 volt pulse would have a duty cycle of 4.5% at the center frequency. For a center frequency of 30 kHz, the 4.5% duty cycle corresponds to a 1.49 msec pulse width. Managing the pulse shape for low radiated emissions for short pulses is a challenge, so that there is an incentive to avoid voltages that are so high that the pulses become too short.

The driver circuit 14, as shown in FIG. 2, comprises a monostable multivibrator 20, which is set at the desired fixed pulse width, and has an output coupled to the gate of a FET 22. The FET 22 in series with a voltage divider 24 is connected between a voltage, say 12 volts, and ground. The node of the divider 24 resistors is coupled to the bases of transistors 26, 28. The transistors, in series with respective current limiting resistors 30, 32, are connected in parallel between the 12 volt source and the filament 10 which provides a path to ground. A capacitor 34 is connected across the filament for pulse shaping purposes. The resistors 30 and 32 are equal and small, on the order of 10 ohms, and are effective to drop the voltage applied to the filament to the desired level to meet the average power needs of the filament. Each time the multivibrator 20 is triggered by the random frequency generator 18, a fixed width pulse is issued to turn on the FET 22 and the transistors 26 and 28 to deliver a current pulse to the filament 10 for the duration of the fixed width pulse.

The random frequency generator 18 includes a shift register 40, a quad 2-input XOR gate 42, a filter 44 and a voltage-to-frequency (V/F) converter 46. The shift register 40 has a data input D, a clock input CL, and eight stages having outputs $Q_A$ through $Q_H$, although only four, $Q_A$, $Q_F$, $Q_G$ and $Q_H$ are used, and are connected to the inputs 1A, 1B, 2A and 2B of two of the XOR gates 42. The other two of the XOR gates are connected in a well known manner to the outputs of the first two gates and to a 5 volt input to produce a logical result yielding a high or 1 at its output Y when 2, 4 or none of the XOR inputs from the shift register are high or 1, and conversely, a 0 output when 1 or 3 or the XOR inputs are high. That output is coupled to the shift register input D and is sequentially shifted through the Q outputs. The end result is a pseudo-random pattern of logic 1's and 0's, having voltage levels of 5 volts and ground respectively. This output may be viewed as a random pulse train of varying duty cycles.

The $Q_H$ output of the shift register is fed to the filter 44 to produce a randomly varying analog voltage. The filter includes two resistors 48 and 50 in series between the input and ground and having a junction point 52, two equal resistors 54 and 56 in series between a 5 volt supply and ground and having a junction point 58, a capacitor 60 between the junction points 52 and 58, and a capacitor 62 between the junction point and ground. The output is the voltage at the junction point 58 and is connected to the voltage input of the V/F converter 46. The center voltage of the junction point is 2.5 volts and varies from that value according to the filter response to the succession of shift register outputs. That response is dependent on the frequency of the data stream as well as the sequence of logic values.

The V/F converter 46 produces an output pulse stream at a random rate in response to the value of the input voltage from the filter. That variable frequency pulse is coupled to the clock input of the shift register 40 as well as to the driver circuit 14. Thus the clock rate of the shift register varies randomly and data is shifted one stage in the register for each filament pulse generated by the driver circuit. The V/F converter is configured to deliver pulses at the desired center frequency, e.g. 30 kHz, for an input voltage of 2.5 volts and to vary throughout the desired frequency band, e.g. 20 kHz to 40 kHz, for the range of the filter output excursion, thereby correlating the frequency output to the voltage range.

It will thus be seen that the method and circuit of the invention supplies a VF tube filament with current pulses to sustain a requisite filament power level and that due to the random nature of the pulse frequency the radiated emissions distribution is favorably changed to effectively distribute the emissions over a broader range, compared to a fixed frequency, and consequently reduce the magnitude of emissions. This is useful in designing VF displays which can meet radiated emissions standards.

The embodiments of the invention in which an exclusive property or privilege is claimed are defined as follows:

1. In a drive circuit for a filament of a vacuum fluorescent tube, a method of providing a pulsed filament current at low radiated emissions comprising the steps of:

generating a random frequency signal variable throughout a range above audible frequencies;

establishing a pulse width and voltage to effect a required filament power; and applying pulses to the filament at the random frequency, whereby radiated emissions are distributed over a frequency band.

2. The invention as defined in claim 1 wherein the established pulse width is a constant value, whereby each pulse has a duty cycle which depends on the pulse period.

3. The invention as defined in claim 1 wherein the range has a center frequency on the order of 30 kHz.

4. The invention as defined in claim 1 wherein the frequency range is about 20 kHz to 40 kHz.

5. The invention as defined in claim 1 wherein the step of generating a random frequency signal comprises the steps of:

generating a random pulse train of different duty cycles;

filtering the random pulse train to produce a variable voltage level; and generating the random frequency signal by converting the variable voltage level to a variable frequency.

6. The invention as defined in claim 5 wherein the step of generating a random pulse train occurs at a clock rate; and the clock rate is determined by the random frequency signal.

7. The invention as defined in claim 5 wherein the variable voltage level is limited to a range; and the step of converting the variable voltage level to a variable frequency comprises controlling the frequency output to the desired range by correlating the frequency output to the variable voltage level range.

8. The invention as defined in claim 1 wherein the step of generating a random frequency comprises:

converting an analog voltage to frequency; and generating the analog voltage by randomly varying a voltage signal and limiting the voltage signal to a voltage range corresponding to the frequency range.

9. A pulsed filament drive circuit for a vacuum fluorescent tube having a low level of radiated emissions comprising:

a random frequency generator operating above the audible frequency range; and a fixed pulse width output circuit driven by the frequency generator for randomly producing filament pulses, whereby radiated emissions are spread over a band.

10. The invention as defined in claim 9 wherein the random frequency generator comprises:

means for generating a randomly variable analog voltage; and means responsive to the analog voltage for producing a frequency output as a function of the analog voltage and including means for limiting the frequency range.

11. The invention as defined in claim 9 wherein the means for limiting the frequency range produces a frequency output from about 20 kHz to about 40 kHz.

12. The invention as defined in claim 9 wherein the random frequency generator comprises:

means for generating a random digital signal;

means for filtering the digital signal to produce a randomly variable analog voltage; and a voltage-to-frequency converter responsive to the analog voltage for producing a frequency output as a function of the variable analog voltage.

13. The invention as defined in claim 12 including feedback means coupling the frequency output to the means for generating a random digital signal.

* * * * *